US005080056A

United States Patent [19]

Kramer et al.

[11] Patent Number: 5,080,056

[45] Date of Patent: Jan. 14, 1992

[54] THERMALLY SPRAYED ALUMINUM-BRONZE COATINGS ON ALUMINUM ENGINE BORES

[75] Inventors: Martin S. Kramer, Romeo; Chester J. Rivard, Sterling Heights; Frank A. Koltuniak, Warren, all of Mich.

[73] Assignee: General Motors Corporation, Detroit, Mich.

[21] Appl. No.: 701,898

[22] Filed: May 17, 1991

[51] Int. Cl.[5] ..... F02F 1/00; F02F 3/00

[52] U.S. Cl. ..... 123/193 CP; 29/888.061; 29/888.048; 92/169.1; 92/223

[58] Field of Search ..... 123/193 P, 193 CP, 668, 123/193 C, 669; 92/169.1, 170.1, 222, 223; 277/189.5; 29/888.01, 888.06, 888.061, 888.04, 888.042, 888.047, 888.048

[56] References Cited

U.S. PATENT DOCUMENTS

| | | | |
|---|---|---|---|
| 3,405,610 | 10/1968 | Hill et al. | 29/888.047 |
| 3,715,790 | 2/1973 | Reinberger | 29/888.048 |
| 3,878,880 | 4/1975 | Jones | 29/888.061 |
| 4,798,770 | 1/1989 | Donomoto et al. | 92/223 |

FOREIGN PATENT DOCUMENTS

| | | | |
|---|---|---|---|
| 0649027 | 9/1962 | Canada | 29/888.061 |
| 1583349 | 1/1981 | United Kingdom | 92/223 |

*Primary Examiner*—E. Rollins Cross
*Assistant Examiner*—Marguirite Macy
*Attorney, Agent, or Firm*—George A. Grove

[57] ABSTRACT

This specification describes the thermal spraying of an aluminum-bronze alloy coating onto aluminum alloy cylinder bores or piston skirts to provide a scuff- and wear-resistant surface.

5 Claims, 1 Drawing Sheet

THERMALLY SPRAYED ALUMINUM-BRONZE COATINGS ON ALUMINUM ENGINE BORES

This invention pertains to cast aluminum automotive engine blocks, and more specifically, it pertains to cast aluminum engines containing a thermally sprayed aluminum-bronze coating on either the cylinder bore of the engine block or the skirt of an aluminum piston.

BACKGROUND OF THE INVENTION

The materials used in automotive engine blocks and in automotive pistons have always had to accommodate wear between the rapidly moving pistons and the cylinder bores in which they reciprocate. Cast iron engine blocks and cast iron pistons are very durable and wear resistant, but they have the disadvantage of excessive weight. Both aluminum pistons and aluminum engine blocks have been used in automotive engines, but some provision must be made to reduce scuffing and wear due to the motion between the piston and its mating cylinder wall.

Iron cylinder liners have been used in cast aluminum engine blocks. However, both the engine block and the cylinder liner must be carefully machined so that they fit together. It is also known to cast the aluminum block around a preformed iron liner, but this complicates the casting process. It is also known to cast the entire aluminum block out of a hypereutectic aluminum-silicon alloy such as 390 aluminum alloy. Such a material is extremely wear resistant, but it is a composition which is difficult to machine and hard to cast. Accordingly, it is preferred not to cast the entire engine block out of the 390 alloy. It has also been practiced to cast the bulk of the aluminum engine block out of a lower silicon content aluminum alloy such as 319 aluminum alloy and then use either iron liners or make provision for a high silicon content aluminum alloy liner. All of these practices have the disadvantage of requiring two different materials in the formation of the engine block and requiring additional expense to insert the cylinder liner material in a suitable fit in the engine block.

Accordingly, it is an object of the present invention to provide an improved method of forming a scuff- and wear-resistant liner in a relatively low silicon content aluminum alloy cast engine block. The new lining material and practice is less expensive to form and provides unexpectedly good wear properties.

It is a further object of our invention to provide a practice for forming a thermal sprayed coating on a low silicon aluminum alloy cast engine block that offers the wear-resistance properties of an iron liner or a high silicon content liner without the attendant costs of forming these structures in the cast block.

It is a still further object of our invention to provide an alternative solution to the scuff problem by providing a thermally-sprayed, wear-resistant coating on a complementary surface such as the skirt of an aluminum piston intended to operate within a high silicon cast aluminum alloy engine block or cylinder bore.

In accordance with a preferred embodiment of our invention, these and other objects of our invention are accomplished as follows.

BRIEF DESCRIPTION OF THE INVENTION

The engine block is cast of a suitable low-silicon aluminum alloy such as the 319 alloy. As is seen in *Metals Handbook, 8th Edition,* American Society of Metals, aluminum 319 nominally contains, by weight, 90.2 percent aluminum, 6.3 percent silicon and 3.5 percent copper. This alloy has long been known as a material that is easily cast into an engine block. In the practice of our invention, the bores for the cylinders are cast a few thousandths of an inch oversize on their internal diameter. The casting is then suitably cleaned, and especially the cylinder bore portion of the casting is thoroughly cleaned and degreased so as to be in suitable condition to receive a thermal sprayed coating of an aluminum-bronze alloy.

Aluminum-bronze alloys are copper-based alloys typically containing about 5 to 12 percent by weight aluminum and optionally small amounts of other elements such as iron, nickel, zinc, manganese and tin with the balance being copper.

In accordance with the practice of our invention, aluminum-bronze compositions are applied by a thermal spray process onto the internal diameter of the cylinder bores of the aluminum casting. A variety of thermal spray processes are known. They typically involve the melting of a wire or powder of the desired composition to be applied and the applying of molten droplets of the composition onto the surface to be coated. The melting of the aluminum-bronze wire or powder is typically accomplished using a combustible gas mixture such as propylene and oxygen or plasma heating or by heating in an electrical arc.

One known thermal spray technique utilizes a double wire of the composition to be applied, the wires being positioned to conduct an electrical current and form an arc between them that melts the composition, and an auxiliary inert gas to blow molten droplets from the arc onto the surface to be coated. This practice, when adapted to be applied to the internal diameter of a bore in the cast engine block, is suitable for forming an aluminum-bronze coating.

In an especially preferred embodiment of our invention, we employ a high velocity oxy-fuel practice in which a wire of the aluminum bronze composition is fed into the combustion flame of a propylene oxygen mixture which is flowing at supersonic speed and the flame conducts the molten aluminum-bronze composition onto the cylindrical surface to be coated. Using such a thermal spray technique, we apply an aluminum-bronze coating several thousandths of an inch thick uniformly over the internal surface of each cylinder bore onto the 319 aluminum alloy casting. The coating is very dense and essentially pore-free. Its outer surface is initially rough and can be smoothed by machining. We machine the applied coating down to the desired diameter of the cylinder bore.

The resultant aluminum-bronze alloy lining on the aluminum alloy engine block is found to provide an excellent wear- and scuff-resistant surface for aluminum pistons in the operation of the engine.

A more detailed description of a suitable apparatus and method for applying the thermal spray aluminum-bronze coating will be found below. In such a description, these and other objects and advantages of our invention will become more clear. Reference will be had to the drawing in which:

FIG. 1 depicts schematically coating apparatus for applying the thermal spray coating of aluminum-bronze onto the internal diameter of the four cylinders depicted in the aluminum cast engine block; and FIGS. 2A–2C show a sequential step operation diagram showing the aluminum-bronze alloy being sprayed (FIG. 2A), the initial machining/cutting operation (FIG. 2B) and the final honing operation (FIG. 2C).

DETAILED DESCRIPTION OF THE INVENTION

Figure 1:
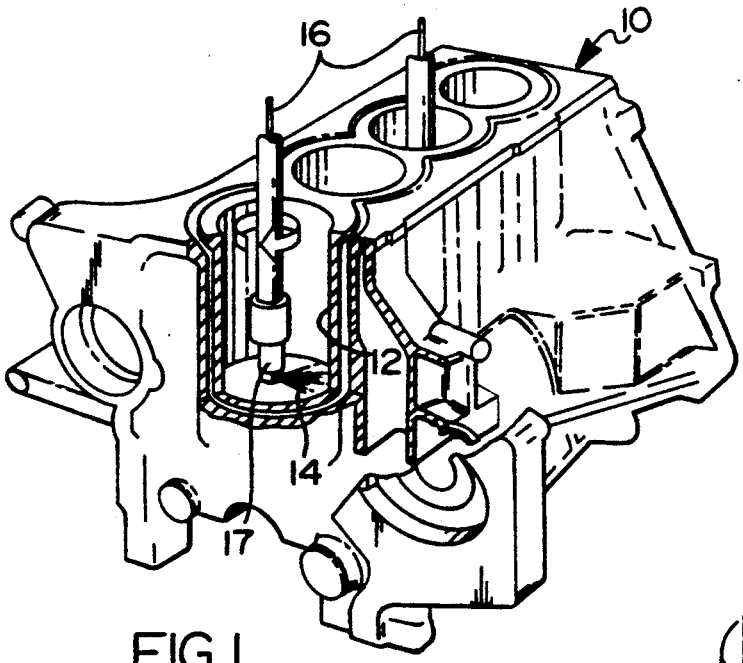

In FIG. 1 is seen a schematic representation partly in section and broken away of a cast aluminum engine block 10 for a four cylinder engine having four cylinder chambers defined therein by cylinder walls 12. In accordance with our invention, it is preferred that the engine block 10 casting be of a suitable aluminum alloy such as 319 alloy, which is known to be readily cast into the complex configuration of an engine block and provide excellent operating service in the engine except for the scuff resistance and wear resistance of the cylinder wall portion of the casting. After the aluminum engine casting has been made, suitable portions may be machined as desired. In particular, the internal diameter of the cylinder walls 12 are machined so that they are a few thousandths of an inch oversize. The cylinder wall 12 portions are then suitably cleaned and degreased.

Then, in accordance with the practice of our invention, a spray 14 of aluminum-bronze alloy is applied to the cylinder walls 12. The aluminum-bronze alloy is supplied to the center of the coating head in the form of a wire 16, which is provided on a spool. A commercially available thermal spray gun apparatus is employed to coat two cylinders at the same time with a coating 14' of aluminum-bronze alloy. This practice is accomplished by using a high velocity oxy-fuel thermal spray practice. High velocity oxy-fuel thermal spray practices and equipment are commercially available for this purpose. In the high velocity oxygen fuel method, a combustion mixture of propylene and oxygen (HVOF) flowing at supersonic speed is introduced down the center of the coating head 17 and ignited using an electric arc spark (not shown) of high voltage and low amperage inside the tip of the coating head 17. Once ignited, the flame is self-sufficient. The aluminum-bronze alloy is melted and blown as a spray by the high velocity gas out of the head 17 and deposited on the interior 12 of the cylinder wall.

The metal spray gun apparatus automatically rotates the coating head 17 about the wire 16 and directs the droplets 14 of the molten wire material against the cylinder walls 12 by moving the head up and down the axis of the cylinder walls. For example, we have used the apparatus like that depicted to deposit a coating of aluminum-bronze alloy 14' on the cylinder wall 12. Each spray gun travels along the cylinder axis at 100 inches per minute while rotating at 800 RPM. The coating of aluminum-bronze alloy 14' was continued until a layer of about 0.040 inch had been formed on the internal diameter of each cylinder bore. Thus, the coating head 17 was moving rapidly up and down in the cylinder bore while rotating to apply molten droplets of aluminum-bronze composition on the cylinder wall. In this case, a one-eighth inch diameter wire of aluminum-bronze composition was used. The composition consisted of about 9 to 11 weight percent aluminum, 1 weight percent iron, 0.2 weight percent tin, and the balance copper. A mixture of 149 SCFH propylene, 606 SCFH oxygen and 1260 SCFH air was used as the fuel and the fluidizing mixture that propelled the molten mixture against the cylinder walls.

Figure 2A:
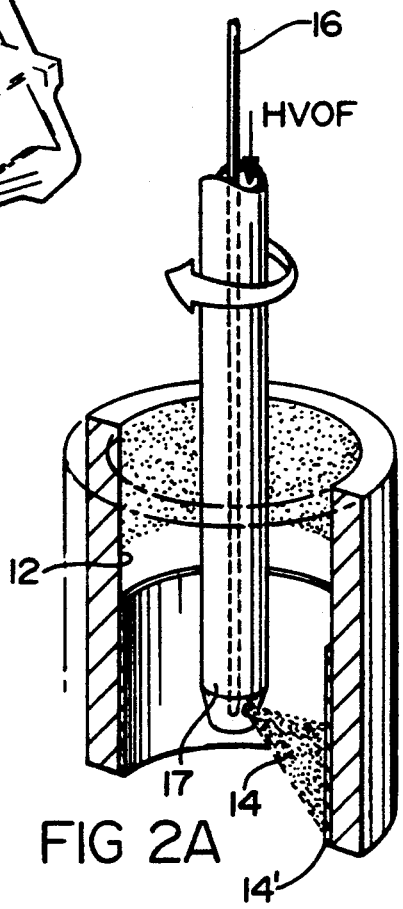
Figure 2B:
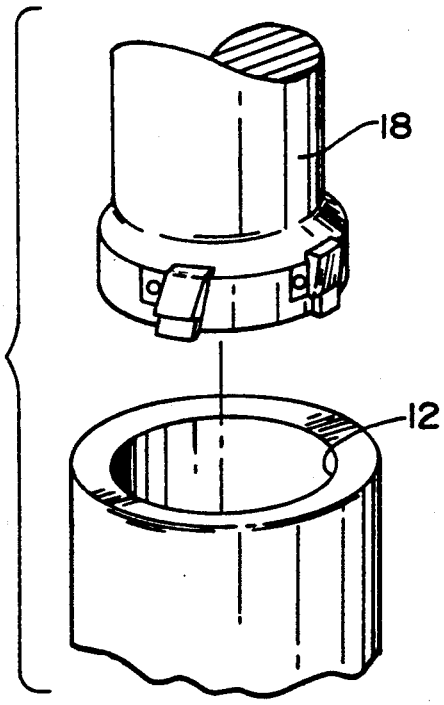
Figure 2C:
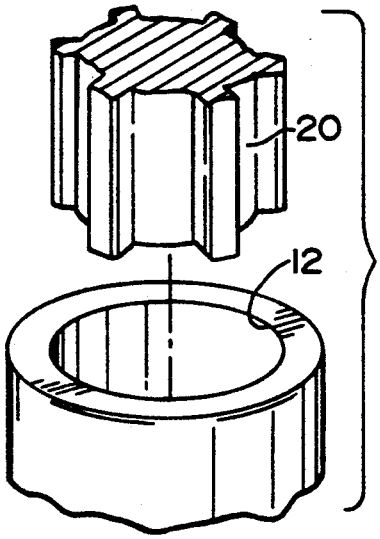

After a suitable thickness of the aluminum-bronze alloy has been applied to the cylinder walls 12, a suitable rotating cutting tool 18 is employed to machine the applied coating to within 0.005 inch of the desired final diameter for the bore. Sufficient excess coating material is applied so that about 30 percent of the coating layer is removed. A suitable finish honing tool 20 is employed to hone the bore to its final diameter and roughness; see FIG. 3. The resultant aluminum-bronze coating depicted especially clearly in FIG. 2A is fully dense, essentially pore-free and provides excellent scuff surface for the operation of an aluminum piston within the fully assembled engine.

Another thermal spray practice that we have evaluated is the two-wire arc practice. In this procedure, the aluminum-bronze alloy in the form of two opposing, nearly touching wires are employed, an electrical current is passed between them so that an electrical arc is struck which melts the material at the arc. A high velocity stream of gas such as nitrogen or air is used to propel the molten material against the cylinder walls, and the wires are continually advanced to each other as the whole apparatus moves up and down within the cylinder wall while the cylinder liner rotates so as to provide a uniform coating over all of the cylinder wall surface. We have found this practice to be less preferred than the high velocity oxy-fuel thermal spray process because porosity is introduced into the double wire arc practice coating. This leads us to conclude that for the purpose of coating aluminum-bronze on aluminum bores and skirts, the practice that best demonstrates utility is the high velocity oxy-fuel method of application.

We have evaluated many different coatings on the wall of low silicon alloy cast aluminum blocks. We have evaluated chrome oxide coatings, stainless steel coatings, molybdenum coatings and aluminum-silicon coatings. None of these coatings produce the same combination of beneficial results as the aluminum-bronze coating. The aluminum-bronze coating is readily applied onto the cylinder wall in a fully dense coating. A few examples of commercially available aluminum-bronze alloys, with their nominal compositions, are aluminum-bronze with 95 percent copper and 5 percent aluminum; aluminum-bronze with 91 percent copper and 9 percent aluminum; aluminum-bronze with 91 percent copper, 7 percent aluminum and 2 percent iron; aluminum-bronze with 89 percent copper, 10 percent aluminum and 1 percent iron; aluminum-bronze with 85 percent copper, 11 percent aluminum and 4 percent iron; aluminum-bronze with 81 percent copper, 11 percent aluminum, 4 percent iron and 4 percent nickel; aluminum-bronze with 81.5 percent copper, 9.5 percent aluminum, 5 percent nickel, 2.5 percent iron and 1.5 percent manganese; and aluminum-bronze with 82 percent copper, 9 percent aluminum, 4 percent nickel, 4 percent iron and 1 percent manganese. Aluminum-bronze provides excellent machinability characteristics so that it can be finished to a desired internal diameter. It provides excellent scuff resistance when used with aluminum pistons, and it is a cost effective material for this application.

Benefit is achieved in suitable applications from applying the coating to pistons, particularly the surface of the aluminum alloy pistons that are employed in a hypereutectic or metal matrix composite aluminum bore engines. Traditional methods of providing a scuff-resistant coating of either iron or chrome have shortcomings of poor adhesion of the coating, blistering and/or flaking of the coating, damaging deposits of chrome within the engine when the chrome releases from its substrate, the iron plating requires the use of copper cyanide which is environmentally unacceptable with respect to disposal of plating materials, and great difficulty is encountered in keeping the plating out of the ring grooves of the piston.

This invention contemplates the thermal spraying of a coating on the piston skirt in the range of 0.001 to 0.040 inch, which eliminates the need for plating and does not adversely affect the machinability of the remainder of the piston.

While our invention has been described in terms of certain embodiments thereof, it will be appreciated that other forms could be readily adapted by those skilled in the art. Accordingly, the scope of the invention is to be considered limited only by the following claims.

The embodiments of the invention in which an exclusive property or privilege is claimed are defined as follows:

1. A method of making a cast hypoeutectic aluminum-silicon alloy engine block with a wear-resistant coating on the surface of the cylinder wall portions thereof comprising casting an aluminum engine block of such an aluminum composition with the cylinder wall portions slightly oversized, applying a coating of an aluminum-bronze alloy to the cylinder wall portions of such castings by melting the aluminum-bronze composition in a high velocity stream of an oxygen hydrocarbon fuel gas and propelling the molten aluminum-bronze alloy onto the surface of the cylinder walls in a uniform layer, the thickness of which is greater than the desired final coating, and machining the aluminum-bronze coating to a desired finished dimension.

2. An aluminum automotive engine block cast of a hypoeutectic aluminum-silicon alloy and containing a dense, thermally sprayed coating of aluminum-bronze alloy applied to the cylinder wall portions of the cast block.

3. An aluminum automotive engine block cast of a hypoeutectic aluminum-silicon 319 alloy and containing a thermally sprayed coating of aluminum-bronze alloy applied to the cylinder wall portions of the cast block.

4. A method of applying a wear-resistant coating of aluminum-bronze alloy to an aluminum alloy automotive piston comprising melting the aluminum-bronze alloy in a high velocity stream of an oxygen-hydrocarbon fuel gas and propelling the molten alloy onto a surface of the piston in a dense, uniform layer, the thickness of which is greater than the desired final coating, and machining the coating to a desired finished dimension.

5. An aluminum alloy automotive piston having a dense, thermally sprayed coating of aluminum-bronze alloy applied to cylinder wall engaging surfaces of the piston.

* * * * *